US007866742B2

(12) United States Patent
LaPointe

(10) Patent No.: US 7,866,742 B2
(45) Date of Patent: Jan. 11, 2011

(54) FURNITURE MEMBER HEAD SUPPORT SYSTEM

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 337 days.

(21) Appl. No.: 12/040,054

(22) Filed: Feb. 29, 2008

(65) Prior Publication Data

US 2009/0218873 A1 Sep. 3, 2009

(51) Int. Cl.
*A47C 1/036* (2006.01)

(52) U.S. Cl. ..... 297/61; 297/408

(58) Field of Classification Search ..... 297/408, 297/403, 61, 396

See application file for complete search history.

(56) References Cited

U.S. PATENT DOCUMENTS 2,690,208 A * 9/1954 Francis ..... 297/403 X
2,952,303 A * 9/1960 Spound et al. ..... 297/61 X
5,464,269 A * 11/1995 Mizelle ..... 297/61 X

* cited by examiner

*Primary Examiner*—Anthony D Barfield
(74) *Attorney, Agent, or Firm*—Harness, Dickey & Pierce, P.L.C.

(57) ABSTRACT

A head rest adjustment system for a furniture member includes a back support member rotatable with respect to a base member. A head rest assembly is connected to the back support member. An adjustment lever rotates the head rest assembly. An actuation link is connected at a first end to the head rest assembly and at a second end to the adjustment lever. Rotating the adjustment lever displaces the actuation link to rotate the head rest assembly to a plurality of support positions. A back support member axis of rotation is spatially separated from an adjustment lever axis of rotation. Rotating the back support member with respect to the base member can independently operate to displace the actuation link to rotate the head rest assembly without rotation of the adjustment lever.

28 Claims, 14 Drawing Sheets

FURNITURE MEMBER HEAD SUPPORT SYSTEM

FIELD

The present disclosure relates to furniture members having mechanisms for positioning portions of the furniture members in multiple operator selected positions.

BACKGROUND

The statements in this section merely provide background information related to the present disclosure and may not constitute prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Known furniture members can also include mechanism designs that also permit the reclining chair to rock in a front-to-back motion with respect to an occupant. Occupant head rest support is commonly provided by one or more cushion members which abut with or are extensions of further cushion members acting as occupant back rest support members. The head rest support is commonly joined at its ends to vertically oriented backrest side support arms which are in turn rotatably connected to a furniture member chair frame.

Most reclining chairs upholster the chair frame and support the chair frame from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed) and elevated (i.e., extended or protracted) positions.

Because head rest support is substantially fixed to the back seat member, as the back seat member rotates the head rest cushion(s) will commonly remain in a fixed orientation with respect to the seat back member. This can result in uncomfortable head rest support positions for the different rotated positions of the seat back. For example, with the seat back member rotated to a fully reclined position, the head rest may be rotated too far backward for comfortable viewing off a television or monitor. Also, with the seat back member rotated to a fully upright position, the head rest may be rotated too far forward for the comfort level desired by the occupant. The above head rest support systems are not adjustable by the occupant, and therefore can result in discomfort in either the fully reclined or fully upright positions, or in the leg rest extended position for different occupants.

SUMMARY

According to several embodiments of the present disclosure, a furniture member head rest adjustment system includes an occupant support base having an arm rest support member. A back support member is rotatable with respect to the occupant support base. A head rest assembly is rotatably connected to the back support member. An adjustment member operates to rotate the head rest assembly. The adjustment member is positioned between an occupant of the furniture member positioned on the base member and the arm rest support member.

According to other embodiments, an actuation link is rotatably connected at a first end to the head rest assembly and at an opposed second end to the adjustment lever, such that rotation of the adjustment lever operates to displace the actuation link to rotate the head rest assembly to a plurality of support positions.

According to further embodiments, a head rest adjustment system for a furniture member includes a furniture member having a back support member rotatable with respect to an occupant support base member. A head rest assembly is rotatably connected to the back support member. An adjustment lever is operable to rotate the head rest assembly. An actuation link is rotatably connected at a first end to the head rest assembly and at an opposed second end to the adjustment lever. Rotation of the adjustment lever operates to displace the actuation link to rotate the head rest assembly to a plurality of support positions. An axis of rotation of the back support member with respect to the base member is spatially separated from an axis of rotation of the adjustment lever such that rotation of the back support member with respect to the base member independently operates to displace the actuation link to rotate the head rest assembly without rotation of the adjustment lever.

According to other embodiments, a furniture member head rest adjustment system includes an occupant support base. A back support member is rotatable with respect to the occupant support base. A head rest assembly is rotatably connected to the back support member. An adjustment lever operates to rotate the head rest assembly. A force multiplying drive mechanism connected to the adjustment lever is operable to incrementally rotate the adjustment lever.

According to other embodiments, the plurality of support positions includes at least a neutral position having the head rest assembly substantially parallel with the back support member, a rearward position rotated in a direction away from the occupant, and a forward position rotated in a direction toward the occupant.

According to other embodiments, a method for controlling adjustment of a furniture member head rest assembly is provided. The furniture member has an occupant support base having an arm rest support member, a back support member, an occupant support base, an adjustment lever, and an actuation link. The method comprises: rotatably joining the back support member to the occupant support base; rotatably connecting the head rest assembly to the back support member; positioning the adjustment lever between an occupant of the furniture member positioned on the base member and the arm rest support member, the adjustment lever operable to rotate the head rest assembly; rotatably coupling the actuation link to both the head rest assembly and to the adjustment lever; and rotating the adjustment lever to simultaneously displace the actuation link and rotate the head rest assembly.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
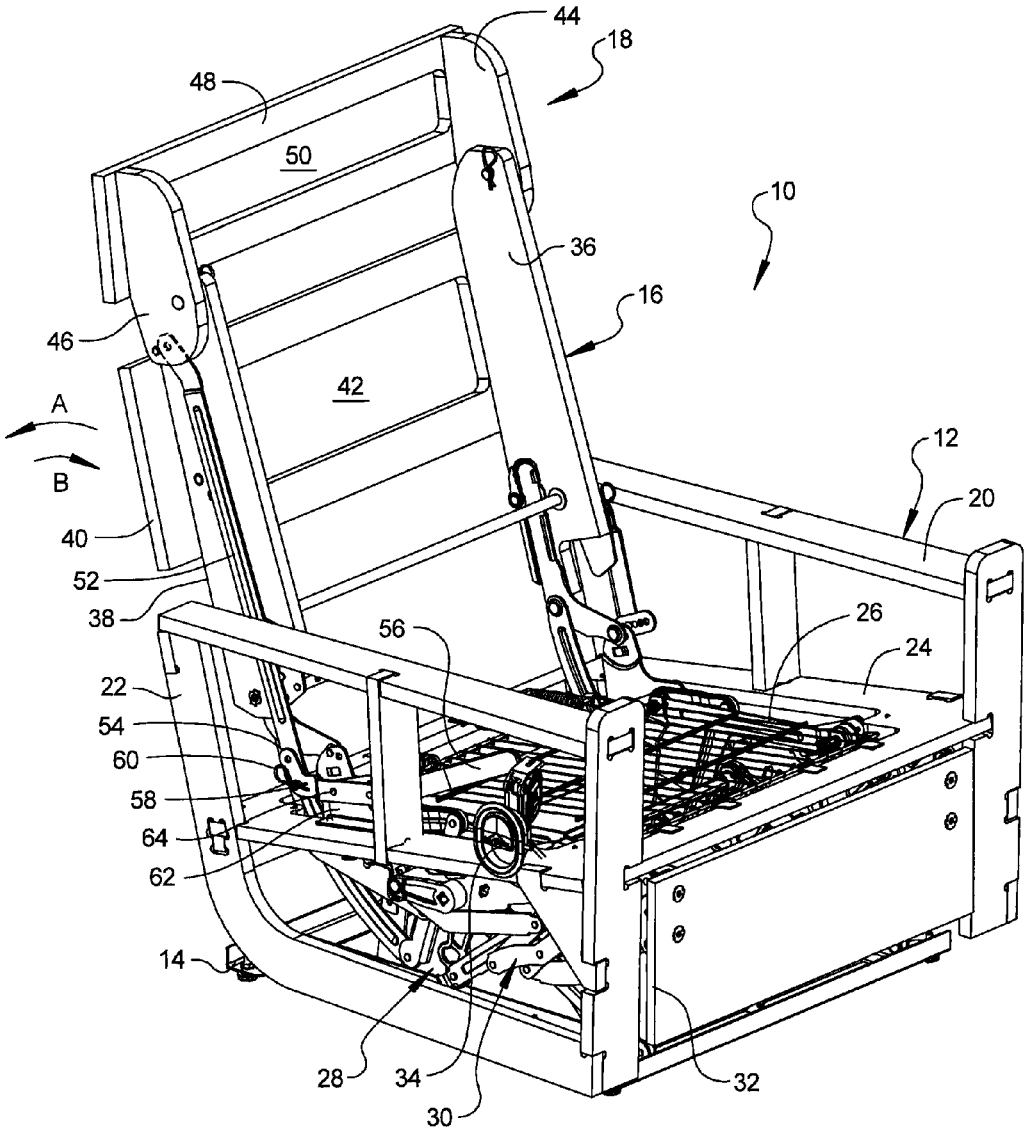
FIG. 1 is a right front perspective view of a furniture member having a head support system of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a furniture member 10 includes a base member 12 which can be fixed, or connected for a rotating and/or a rocking motion with respect to a stationary support assembly 14. Furniture member 10 is depicted without subsequent layers of padding, cushions, or the like which are commonly known in the industry. Furniture member 10 also includes a back support member 16, a head rest assembly 18 rotatably connected to back support member 16, first and second oppositely "handed" armrest support members 20, 22 fixedly connected to base member 12, and a seat pan 24 adapted to transfer the weight of an occupant of the furniture member 10 to the base member components. An elastically flexible occupant support member 26 is connected across an opening created in seat pan 24 to support the occupant's weight. A mechanism 28 can be provided within the base member 12 which can include a pantograph linkage set 30 operable to extend and retract a leg rest assembly 32. Leg rest assembly 32 is released from the stowed position shown using an extension release 34, or a rotatable handle commonly known in the industry (not shown).

Back support member 16 includes each of a first support wing 36, a second support wing 38, and a brace member 40 which is fixed to each of first and second support wings 36, 38 to retain first and second support wings 36, 38 substantially parallel to each other and oriented vertically when viewed from the front of the furniture member 10. An aperture 42 is provided in brace member 40 to reduce the weight of brace member 40. Brace member 40, similar to most of the members of base member 12 is constructed of wood such as plywood for strength and light weight. Back support member 16 is rotatably connected to furniture member 10 using mechanism 28 which permits back support member 16 to rotate in either of a rearward or reclining direction arc of rotation "A" or to return back support member 16 to the fully upright position shown in a forward direction arc of rotation "B".

Head rest assembly 18 is also constructed primarily of wood such as plywood and includes each of a first and second side support member 44, 46 which are individually rotatably connected to first and second support wings 36, 38. A second brace member 48, constructed similar to brace member 40 is fixedly connected to first and second side support members 44, 46 to retain first and second side support members 44, 46 substantially parallel to each other and oriented vertically when viewed from the front of the furniture member 10. An aperture 50 similar to aperture 42 is created in head rest assembly 18 to minimize weight.

Head rest assembly 18 is rotatably adjustable from a neutral position shown to multiple rotated positions, either forwardly or rearwardly with respect to an occupant. Head rest assembly 18 is rotated by displacement of an actuation link 52. Actuation link 52 is rotatably coupled to a link connecting end 54 of a handle or an adjustment member or lever 56. Link connecting end 54 of adjustment lever 56 is connected to actuation link 52 using a pin 58 and a releasable fastener 60. Adjustment lever 56 is rotatably connected to a bracket 62 and is manually rotatable about an axis of rotation defined by the longitudinal axis of a rotation pin 64 such as a spin rivet. Adjustment lever 56 is positioned between an occupant of furniture member 10 and second arm rest support member 22 so that the occupant can adjust the position of head rest assembly 18 without reaching outside of second arm rest support member 22. According to several embodiments, adjustment lever 56 includes a handle grip member 57 adapted to permit the adjustment lever 56 to be directly manually rotatable.

Figure 2:
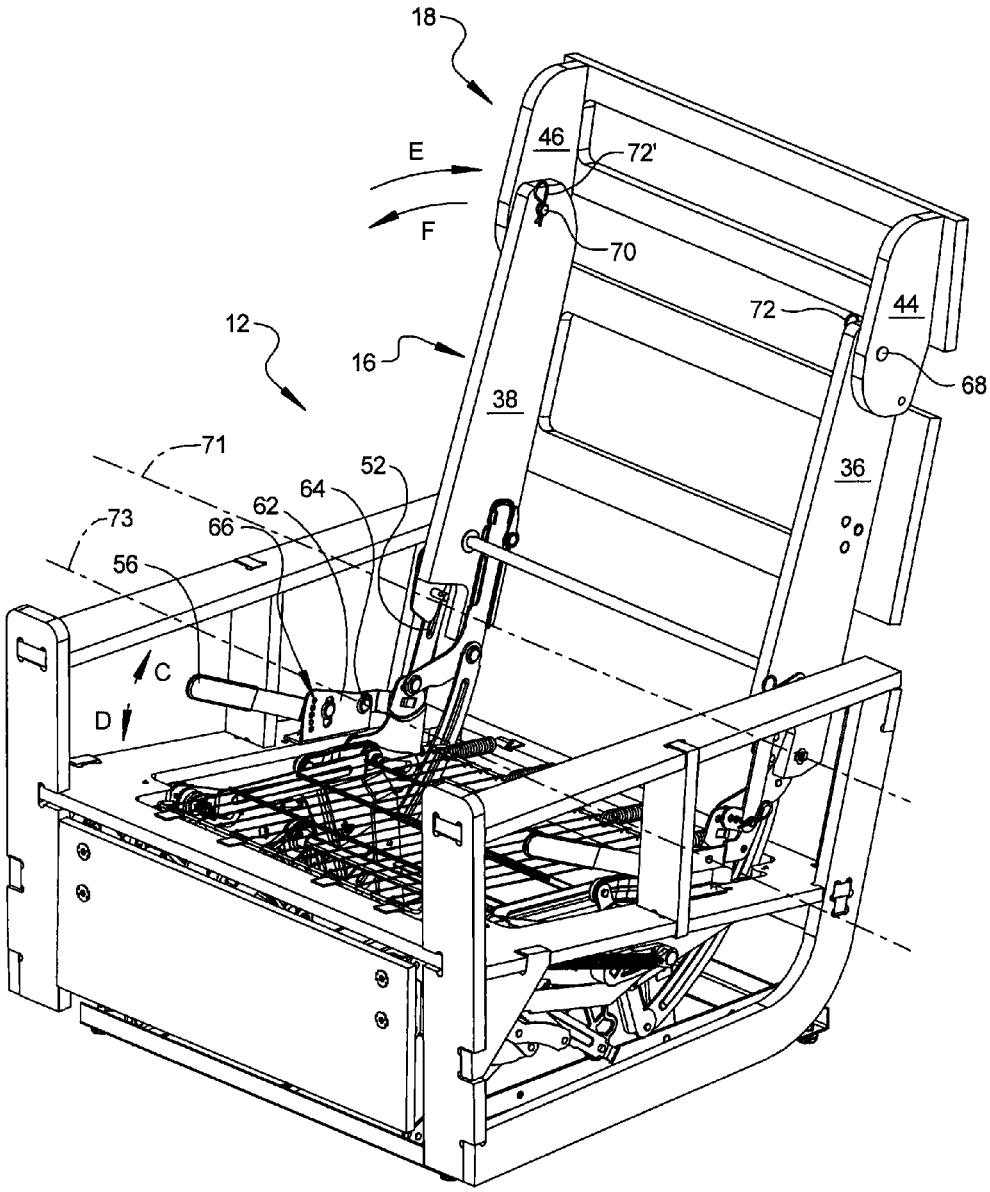
FIG. 2 is a left front perspective view of the furniture member of FIG. 1.

Referring to FIG. 2, adjustment lever 56 is rotatably connected to bracket 62 by rotation pin 64 such that adjustment lever 56 can rotate from the neutral position shown in each a head rest adjustment direction "C" or alternately in a head rest adjustment direction "D". A plurality of detent settings 66 are provided with bracket 62 which are releasably engaged by elastically deflectable members (not shown) provided with adjustment lever 56 which permit the adjustment lever 56 to be temporarily and releasably held in each of a multiple number of positions each providing for a different rotational angle of head rest assembly 18 varying from the neutral position shown. For example, rotation of adjustment lever 56 in the head rest adjustment direction "C" displaces actuation link 52 causing rotation of head rest assembly 18 in a head rest reclining direction "E". Alternately, rotation of adjustment lever 56 in the head rest adjustment direction "D" oppositely displaces actuation link 52 and causes rotation of head rest assembly 18 in a head rest forward direction "F". Head rest assembly 18 is rotatably connected to back support member 16 using each of a first fastener 68, a second fastener 70, and releasable fasteners 72, 72'.

First fastener 68 is inserted through both first side support member 44 and first support wing 36. Similarly, second fastener 70 is inserted through each of second side support member 46 and second support wing 38. Releasable fasteners 72, 72' retain first and second fasteners 68, 70 while permitting rotation of head rest assembly 18 with respect to back support member 16. Back support member 16 has an axis of rotation 71 with respect to base member 12. Adjustment lever 56 has an axis of rotation 73 defined by a longitudinal axis of rotation pin 64. The axis of rotation 71 of the back support member 16 with respect to the base member 12 is spatially separated from the axis of rotation 73 of the adjustment lever 56 such that rotation of the back support member 16 with respect to the base member 12 independently operates to displace the actuation link 52 to rotate the head rest assembly 18 without rotation of the adjustment lever 56.

Figure 3:
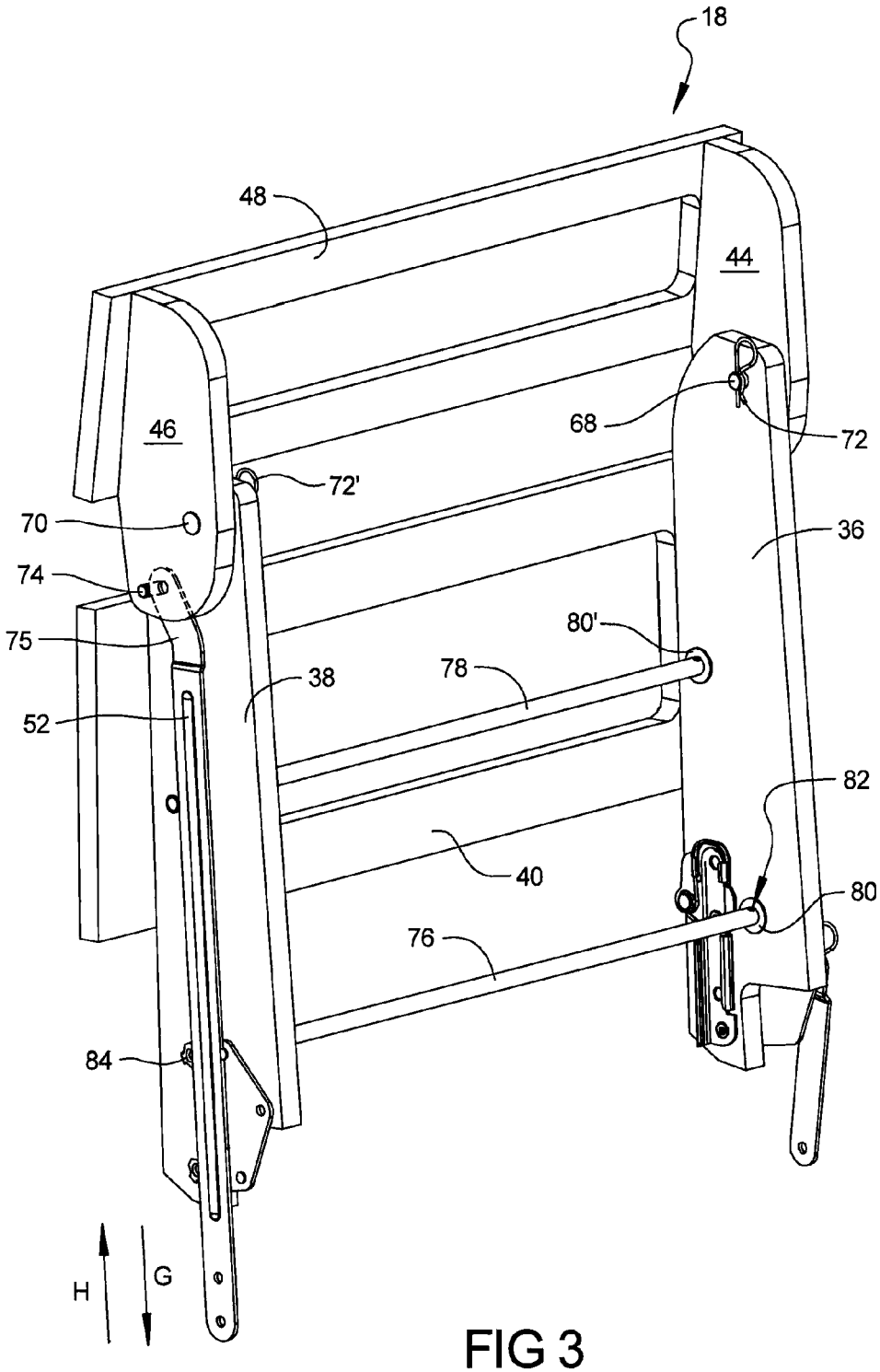
FIG. 3 is a right front perspective view of a back support member and head rest assembly of the furniture member of FIG. 1.

Referring to FIG. 3, actuation link 52 is connected to second side support member 46 using a connecting fastener 74. Connecting fastener 74 is rotatably disposed through second side support member 46 such that a first end 75 of actuation link 52 can rotate as actuation link 52 is displaced in each of a head rest reclining displacement direction "G" and an opposite head rest forward rotation displacement direction "H". The first end 75 of actuation link 52 is disposed between second side support member 46 and second support wing 38 to position actuation link 52 proximate to second support wing 38.

Additional support members can also be provided to control a spacing of each of first and second support wings 36, 38. According to several embodiments a first member 76 and a second member 78 can be connected between first and second support wings 36, 38 each having a washer 80, 80' disposed at shoulder ends 82 of each of the first and second members 76, 78. A member engagement fastener 84 can also be used to fastenably engage both first and second members 76, 78 on an outward face of each of the first and second support wings 36, 38.

Figure 4:
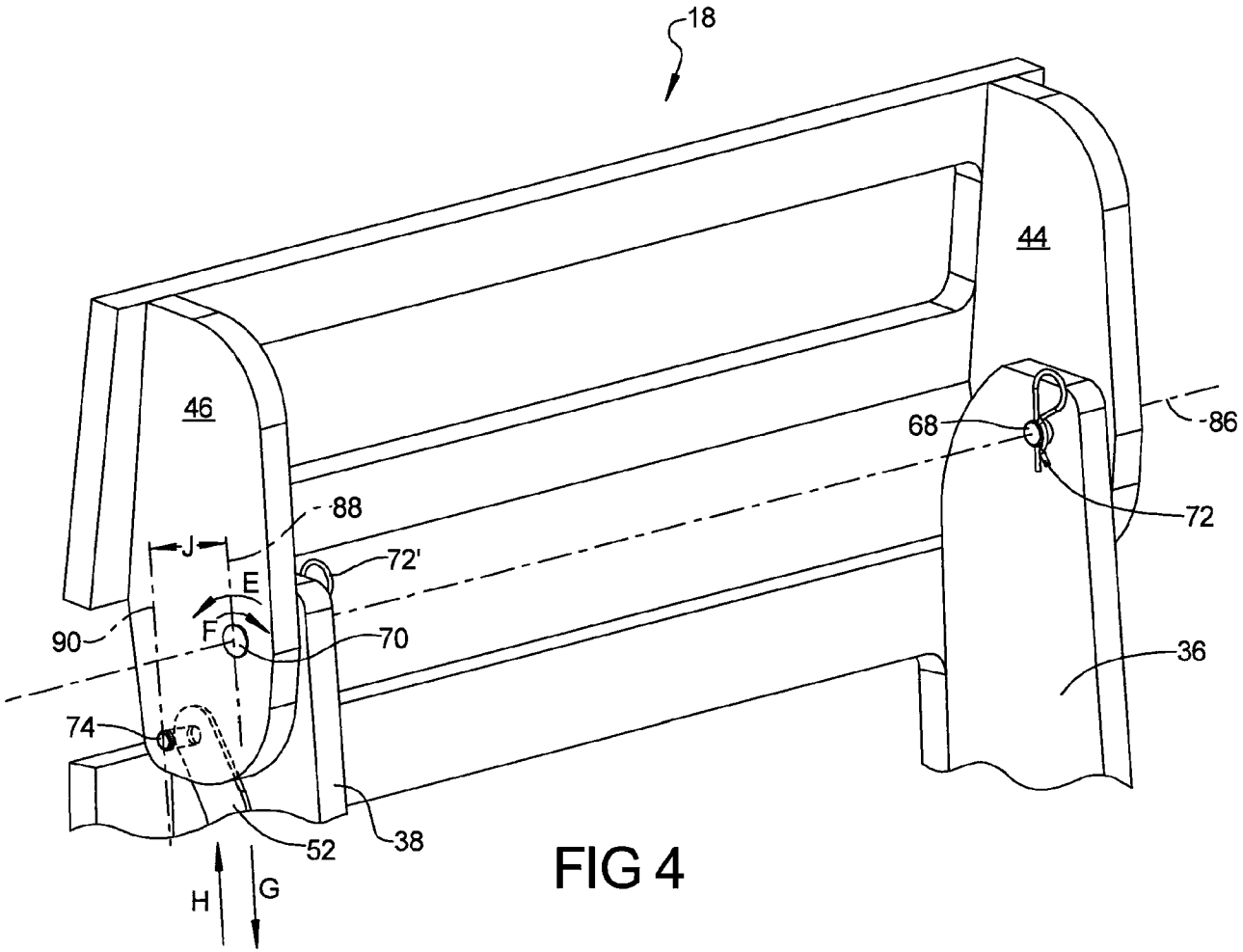
FIG. 4 is a partial perspective view of FIG. 3.

Referring to FIG. 4, the first and second fasteners 68, 70 together define a head rest axis of rotation 86 defined through a longitudinal axis of the first and second fasteners 68, 70. Head rest assembly 18 is rotatable about head rest axis of rotation 86 by displacement of actuation link 52 in either of the head rest reclining displacement direction "G" or the head rest forward rotation displacement direction "H" as previously noted. A rotational force is created by positioning connecting fastener 74 horizontally apart from second fastener 70. As shown, a first fastener vertical axis 88 defined through second fastener 70 is separated by a horizontal spacing "J" from a second fastener vertical axis 90 of connecting fastener 74. Horizontal spacing "J" creates a moment arm between second fastener 70 and connecting fastener 74 such that motion of actuation link 52 in the head rest reclining displacement direction "G" causes rotation of head rest assembly 18 in the head rest reclining direction "E" and displacement of actuation link 52 in the head rest forward rotation displacement direction "H" causes rotation of head rest assembly 18 in the head rest forward rotation direction "F".

Figure 5:
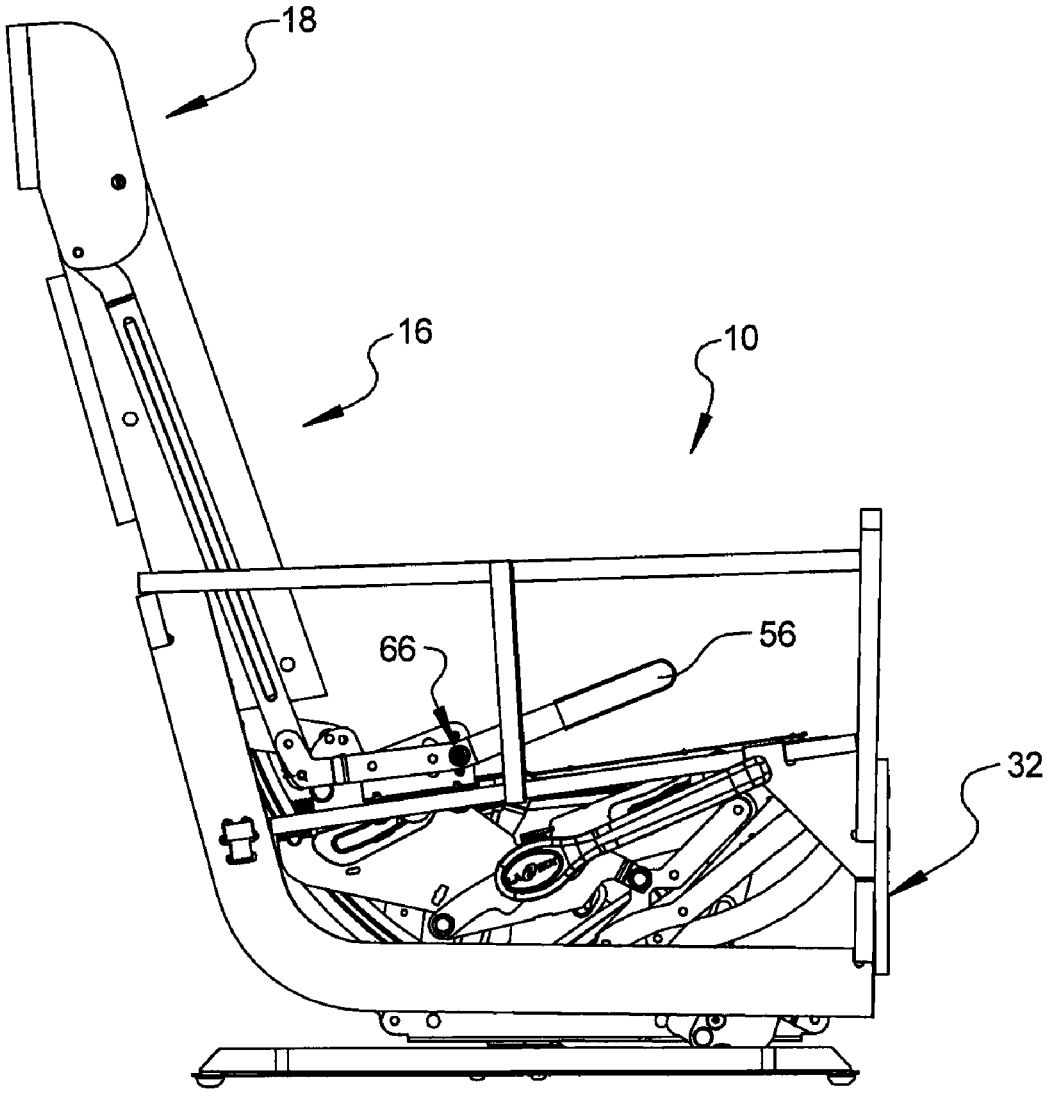
FIG. 5 is a side elevational view of the furniture member of FIG. 1 with the head rest assembly in a neutral position.

Referring to FIG. 5, furniture member 10 is shown having the back support member 16 in a fully upright position and head rest assembly 18 in a neutral position (substantially parallel to back support member 16). Leg rest assembly 32 is in a stowed position. At this time, adjustment lever 56 is positioned in the middle or neutral position with respect to the plurality of detent settings 66.

Figure 6:
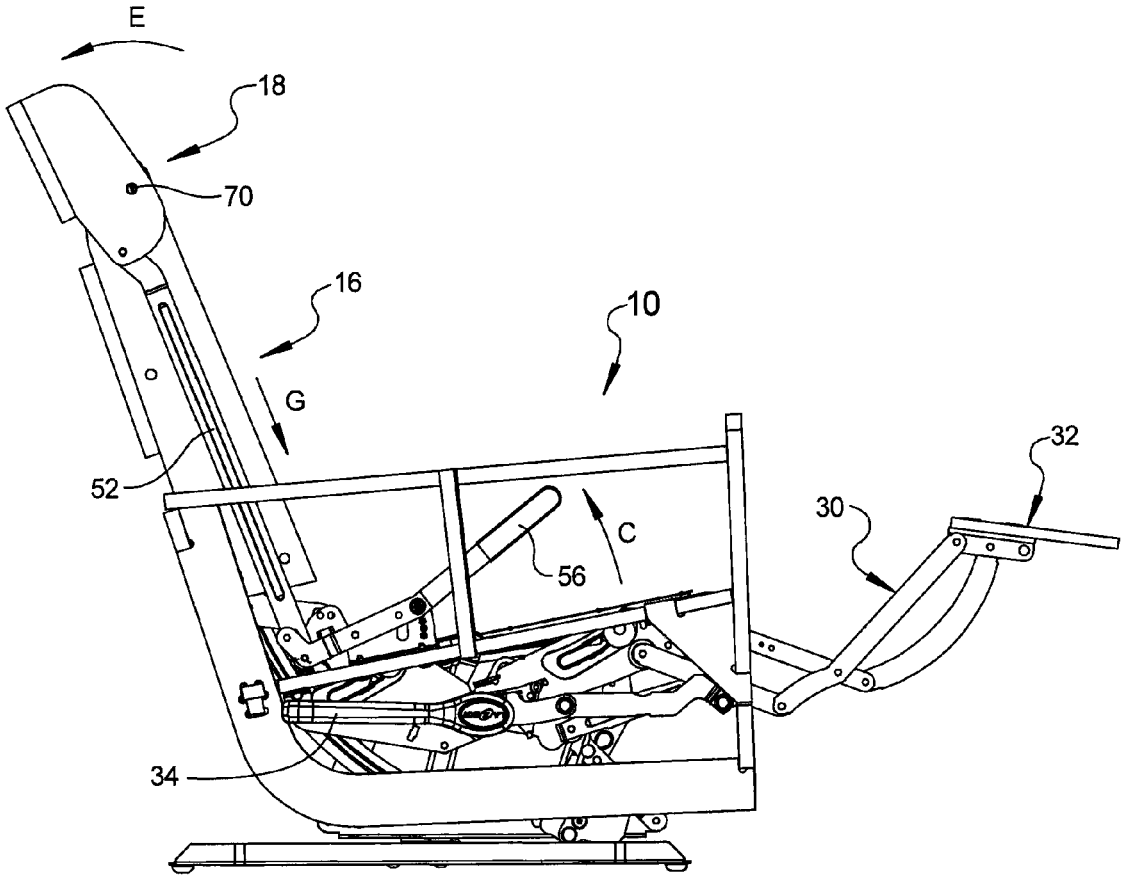
FIG. 6 is a side elevational view modified from FIG. 5 modified to shown the leg rest assembly in an extended position and the head rest assembly in a rearwardly rotated position.

Referring to FIG. 6, extension release 34 is actuated to move leg rest assembly 32 from the stowed to an extended position having pantograph linkage set 30 fully extended. Back support member 16 is retained in the fully upright position. Extension of leg rest assembly 32 does not effect the position of either back support member 16 or head rest assembly 18. By rotating adjustment lever 56 in the head rest adjustment direction "C", actuation link 52 is displaced in the head rest reclining displacement direction "G". This rotates head rest assembly 18 about second fastener 70 in the head rest reclining direction "E". The orientation of head rest assembly 18 is shown in a maximum negative head rest inclination with respect to the back support member 16. Head rest assembly 18 is negatively or rearwardly rotated as shown in FIG. 6 approximately 22° compared to the neutral position of head rest assembly 18 shown in FIG. 5.

Figure 7:
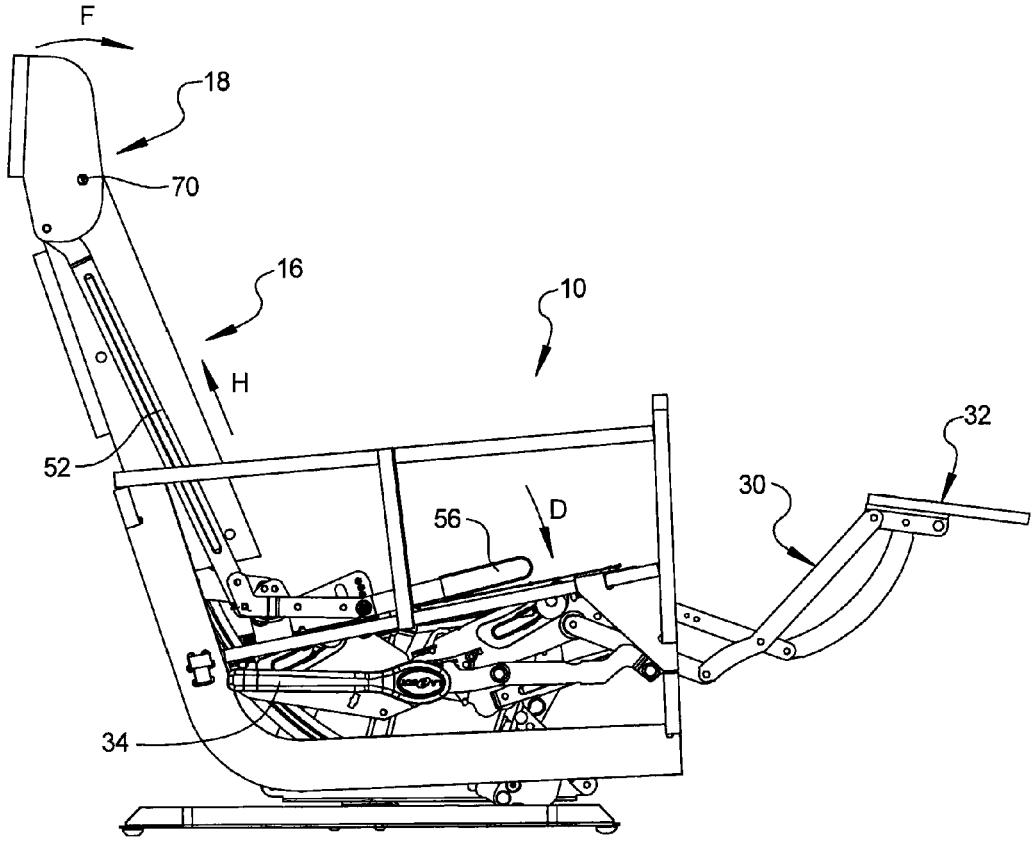
FIG. 7 is a side elevational view similar to FIG. 6, modified to show the head rest assembly in a forwardly oriented position.

Referring to FIG. 7, with back support member 16 retained in the fully upright position the orientation of head rest assembly 18 is repositioned from that shown in FIG. 6 to a maximum positive head rest inclination by rotating adjustment lever 56 in the head rest adjustment direction "D". Actuation link 52 is displaced in the head rest forward rotation displacement direction "H". This displacement of actuation link 52 causes rotation of head rest assembly 18 about second fastener 70 in the head rest forward rotation direction "F". Head rest assembly 18 is rotated approximately 22° forward in the orientation shown in FIG. 7 from the neutral position shown in reference to FIG. 5.

Figure 8:
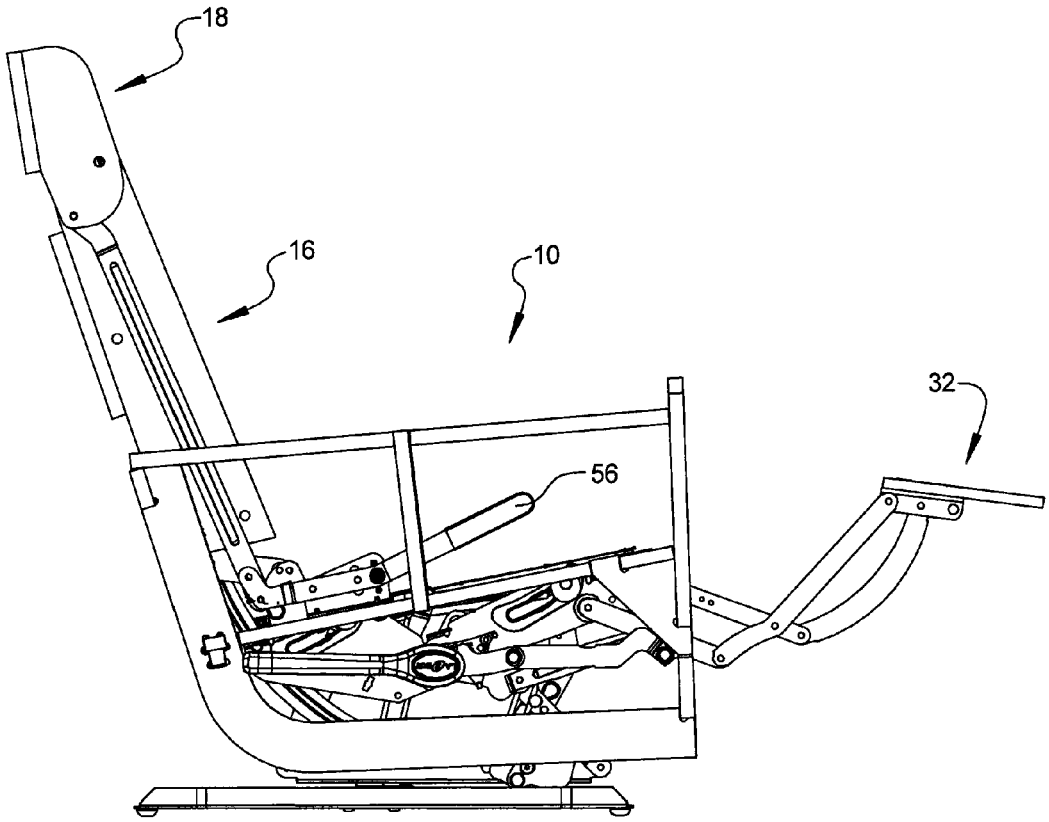
FIG. 8 is a side elevational view similar to FIG. 6 with the head rest assembly positioned in the neutral position.

Referring to FIG. 8, furniture member 10 is shown with leg rest assembly 32 in the fully extended position and the back support member 16 in the fully upright position. Head rest assembly 18 and adjustment lever 56 are both shown in their neutral positions. The extension or degree of extension of leg rest assembly 32 does not impact the ability to maintain furniture member 10 in the fully upright position or to maintain head rest assembly 18 in the neutral position.

Referring to FIG. 9 and again to FIG. 2, furniture member 10 is shown with leg rest assembly 32 in the fully extended position and back support member 16 in a fully reclined position. A second end 77 of actuation link 52 is connected to adjustment lever 56. As back support member 16 rotates toward the fully reclined position in reclining direction arc of rotation "A", adjustment lever 56 remains stationary with respect to base member 12 about rotation pin 64. Because back support member 16 rotates with respect to the back support member axis of rotation 71 located apart from the axis of rotation 73 defined by rotation pin 64, actuation link 52 synchronously translates in the head rest reclining displacement direction "G". This causes an arc of rotation "X" of actuation link 52 with respect to connecting fastener 74 of approximately two to four degrees. Synchronous translation of actuation link 52 causes rotation of head rest assembly 18 in the head rest forward rotation direction "F" even through adjustment lever 56 remains in the neutral position. Therefore, in the neutral position of adjustment lever 56 with back support member 16 in the fully reclined position, head rest assembly 18 synchronously rotates forward to provide additional head rest support for a furniture member occupant, for example for better viewing of a television or similar apparatus.

If desired by the occupant, with back support member 16 in the fully reclined position adjustment lever 56 can be rotated in either of the head rest adjustment direction "C" or the head rest adjustment direction "D" to further adjust an orientation of head rest assembly 18. In the position shown in FIG. 9, head rest assembly 18 is rotated approximately 22° forward from the neutral position shown in reference to FIG. 5. As previously noted, rotation of the back support member 16 with respect to the base member 12 independently operates to displace the actuation link 52 to rotate the head rest assembly 18 without rotation of the adjustment lever 56. An angular orientation of the head rest assembly 18 with respect to the back support member 16 continually changes as the back support member 16 rotates from the upright position to the fully reclined position.

Figure 9:
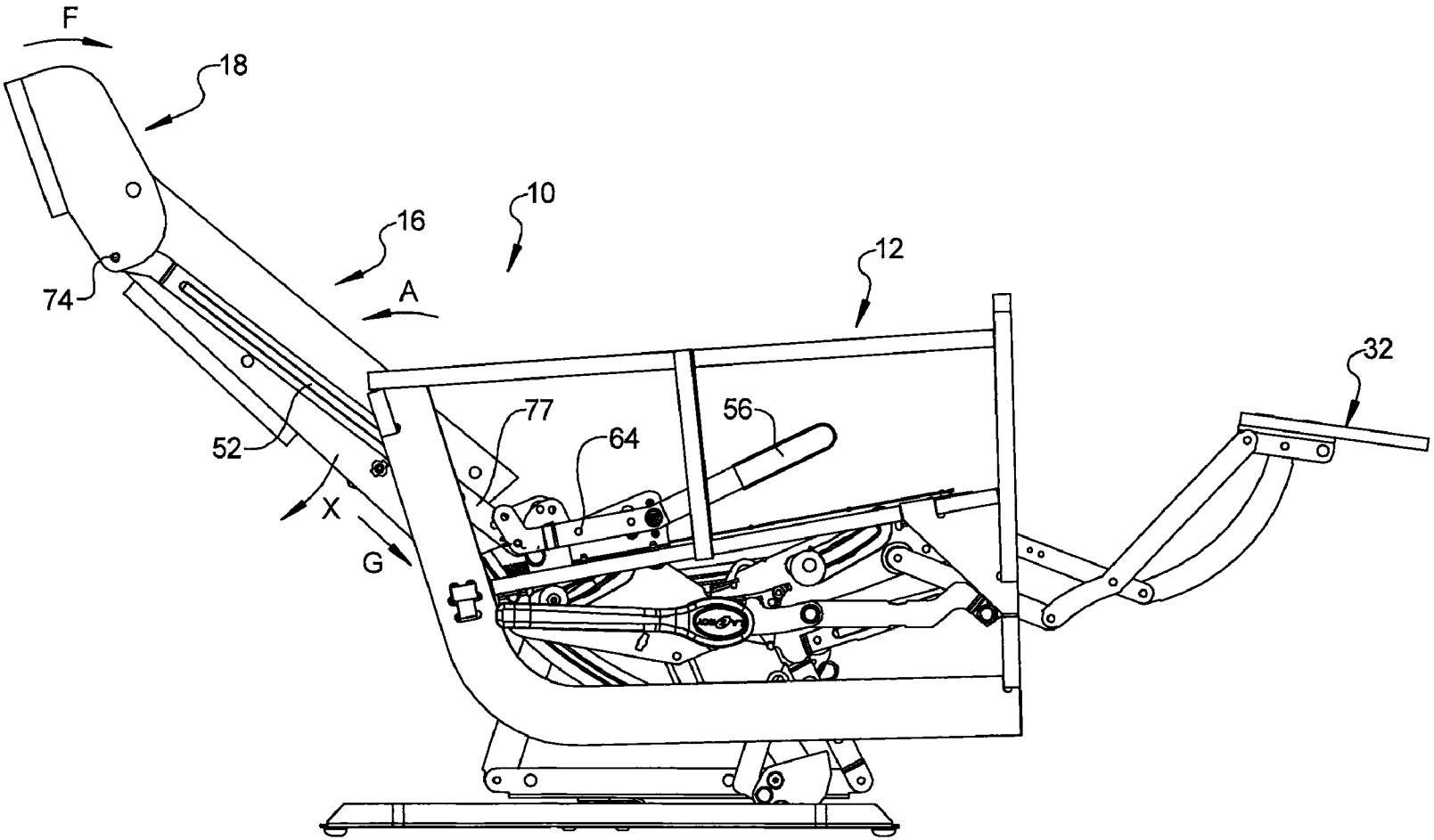
FIG. 9 is a side elevational view modified from FIG. 7 to show the back support member in a fully reclined position.
Figure 10:
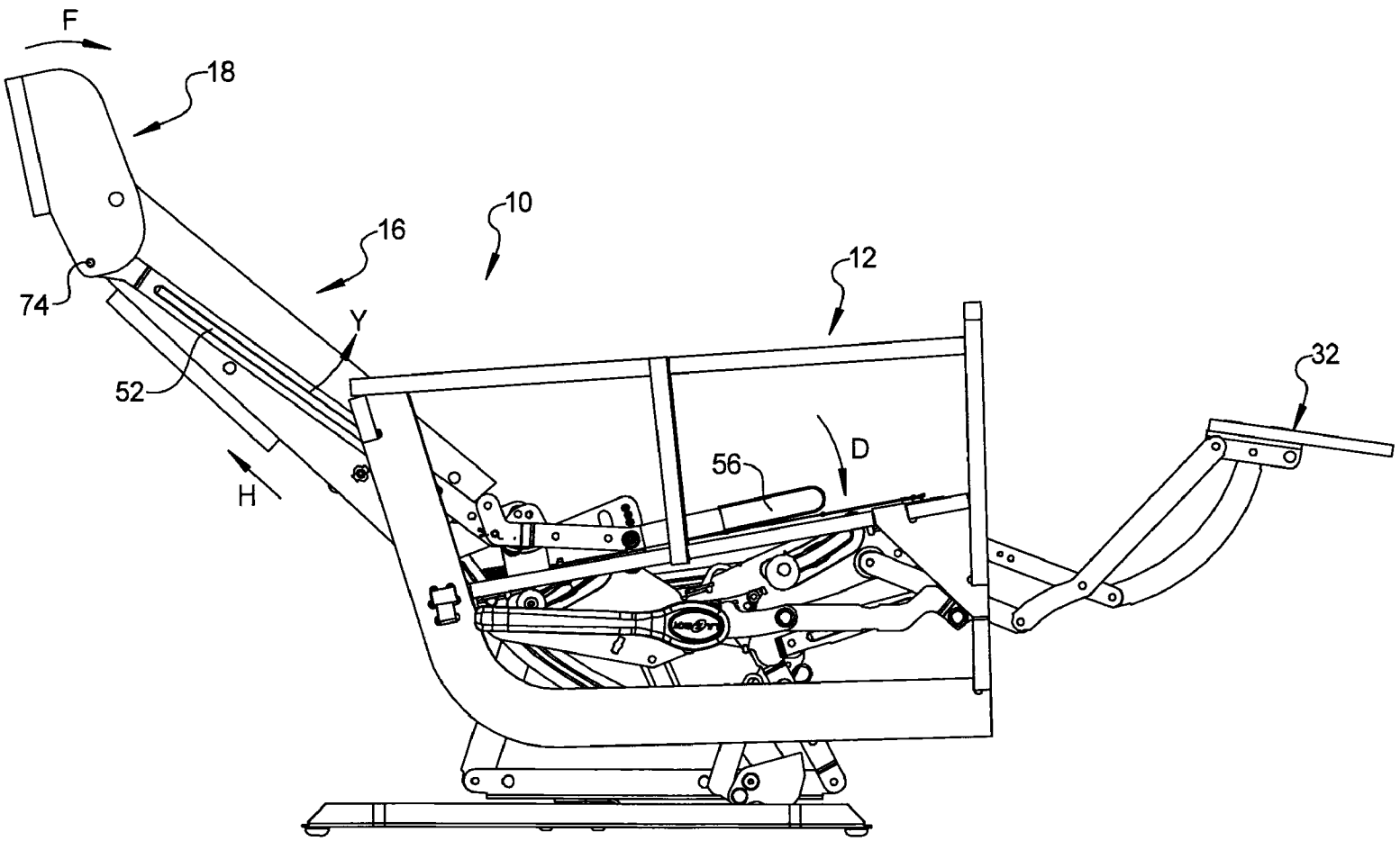
FIG. 10 is a side elevational view modified from FIG. 9 to show the head rest assembly adjusted to a fully forward position.

Referring to FIG. 10 and again to FIG. 9, by rotating adjustment lever 56 in the head rest adjustment direction "D" from the neutral position shown in FIG. 9 to the maximum forward adjustment position of adjustment lever 56, head rest assembly 18 can be further rotated in the head rest forward rotation direction "F" by approximately 9° from the position of head rest assembly 18 shown in reference to FIG. 9. This rotation of adjustment lever 56 in the head rest adjustment direction "D" displaces actuation link 52 in the head rest forward rotation displacement direction "H". Actuation link 52 also rotates in a direction "Y" with respect to connecting fastener 74 by approximately two to four degrees as adjustment lever 56 is rotated.

Figure 11:
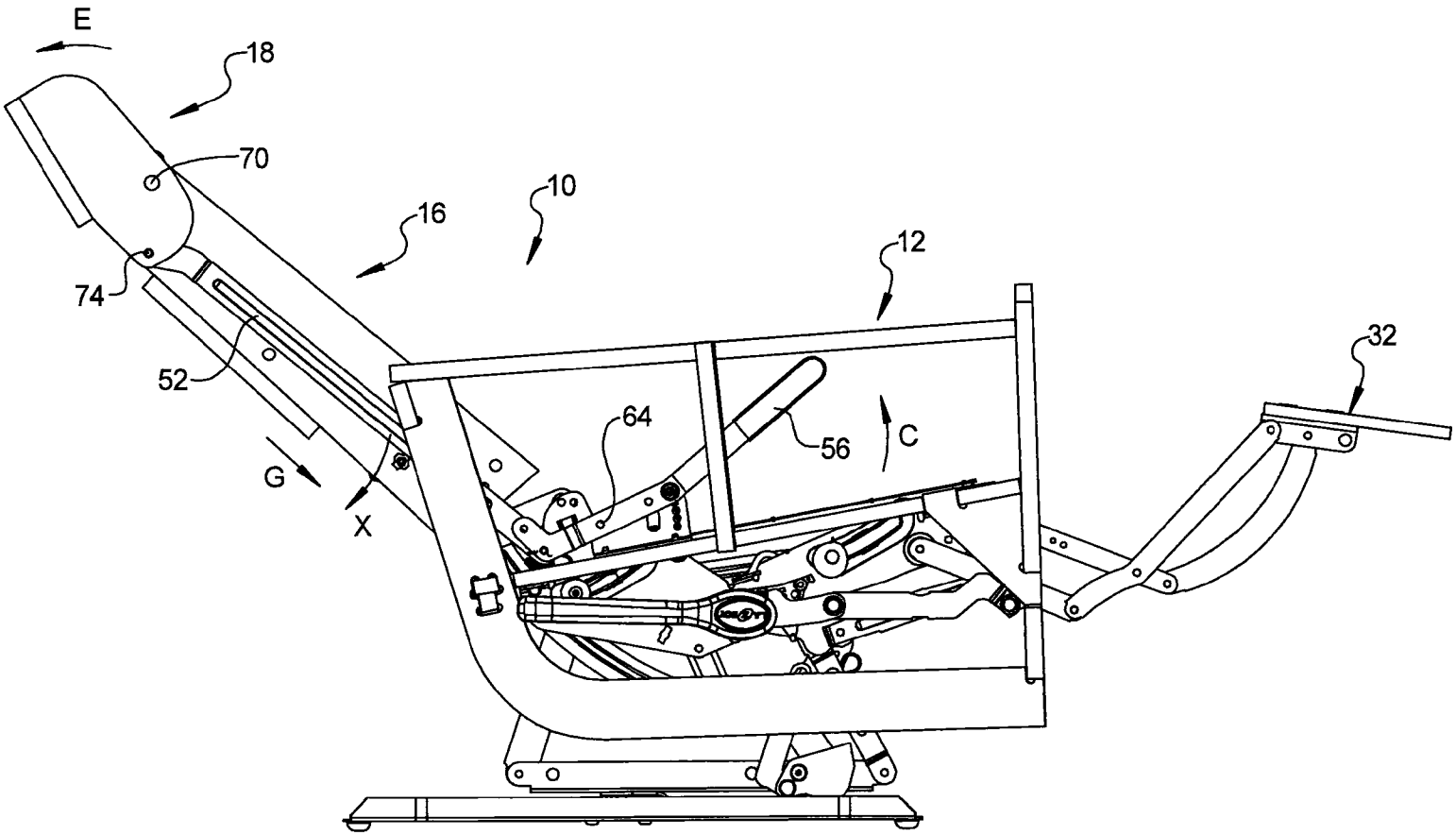
FIG. 11 is a side elevational view modified from FIG. 9 to show the head rest assembly adjusted to a fully rearward position.

Referring to FIG. 11 and again to FIG. 9, by rotating adjustment lever 56 in the head rest adjustment direction "C" from the neutral position shown in FIG. 9 to a fully reclining head rest position, head rest assembly 18 is rotated in the head rest reclining direction "E" by approximately 9° from the position shown in reference to FIG. 9. Actuation link 52 displaces in the head rest reclining displacement direction "G" and rotates with respect to connecting fastener 72 in the direction of rotation "X". A total angular displacement between the head rest assembly 18 position shown in reference to FIG. 10 to the head rest position shown in reference to FIG. 11 is approximately 18°. It should be evident that the total amount of rotation of head rest assembly 18 can be modified by changing the geometry of actuation link 52 such as lengthening or shortening the actuation link 52, changing the position of connecting fastener 74 with respect to second fastener 70, and/or modifying the connection point of rotation pin 64.

Figure 12:
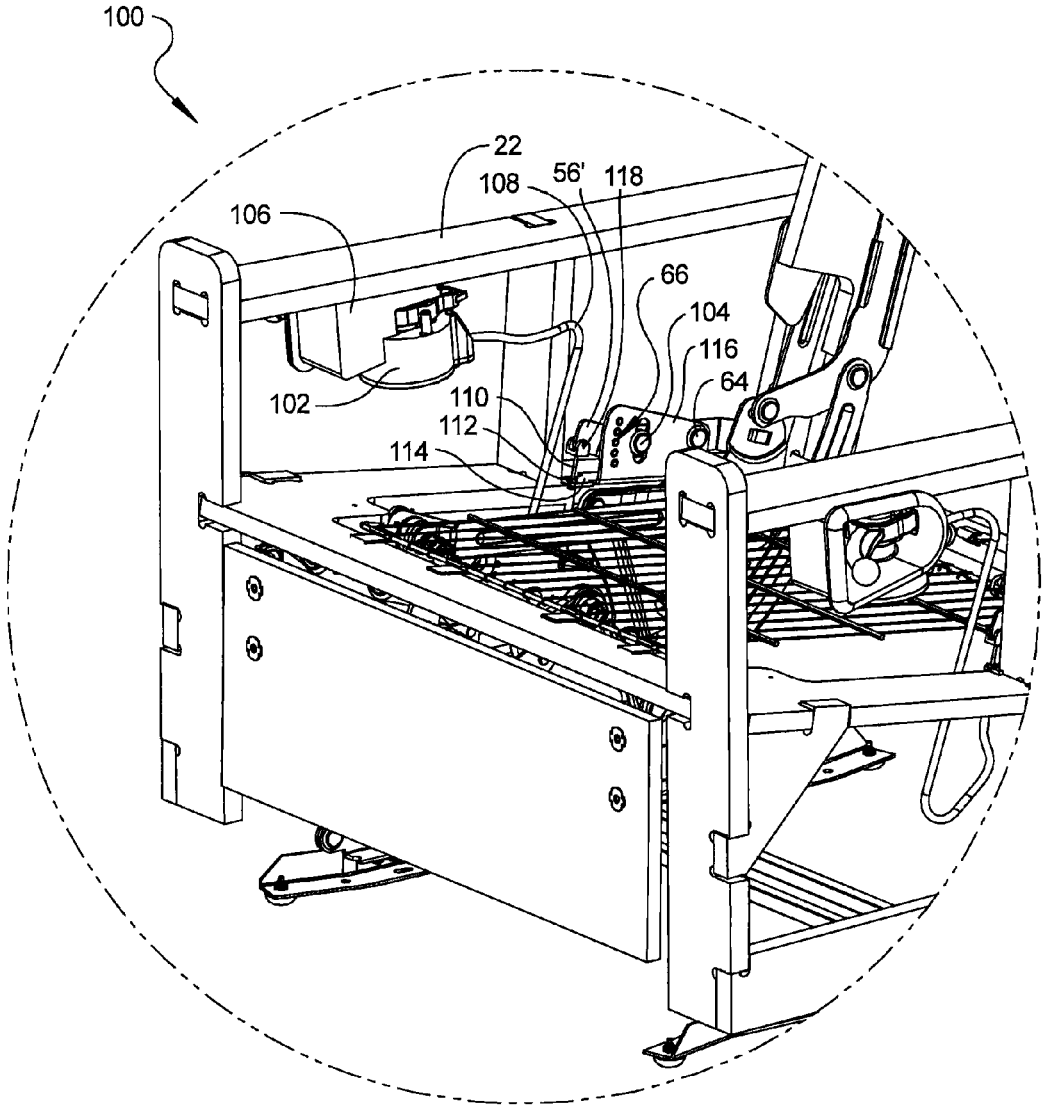
FIG. 12 is a left front perspective view of another embodiment of a furniture member having a force multiplying drive mechanism operable to rotate the head rest assembly.

Referring to FIG. 12 and again to FIG. 2, according to further embodiments a furniture member 100 is modified from furniture member 10 to include a force multiplying drive mechanism 102 used to mechanically actuate a modified adjustment lever 56' to control a degree of head rest adjustment for furniture member 100. Modified adjustment lever 56' eliminates the handle grip end and has a reduced length compared to adjustment lever 56. Adjustment lever 56' is still rotatable with respect to rotation pin 64 and is limited in its angular displacement by a support pin 104, similar to adjustment lever 56. Drive mechanism 102 is connected to a housing 106 which can be fixedly connected to arm rest support member 22. A flexible sheath 108 extends from drive mechanism 102 having an internally disposed, sliding wire member 110. A stop member 112 connects an end of flexible sheath 108 to a bracket extension 114 of a bracket 116 which is modified from the configuration of bracket 62 to include bracket extension 114. Wire member 110 is connected to a rotatable connector 118 which is in turn rotatably connected to modified adjustment lever 56'.

Wire member 110 is slidably displaced within flexible sheath 108 by actuation of drive mechanism 102 such that wire member 110 extends or retracts with respect to flexible sheath 108 to displace modified adjustment lever 56' in either of the head rest adjustment directions "C" or "D". Modified adjustment lever 56' rotates with respect to handle rotation pin 64 to displace actuation link 52 as previously described in reference to FIGS. 1-3. Because force multiplying drive mechanism 102 operates to incrementally move wire member 110, the plurality of detent settings 66 can also be eliminated from this embodiment, at the manufacturer's discretion, to provide a greater degree of angular control of modified adjustment lever 56' rotation.

Figure 13:
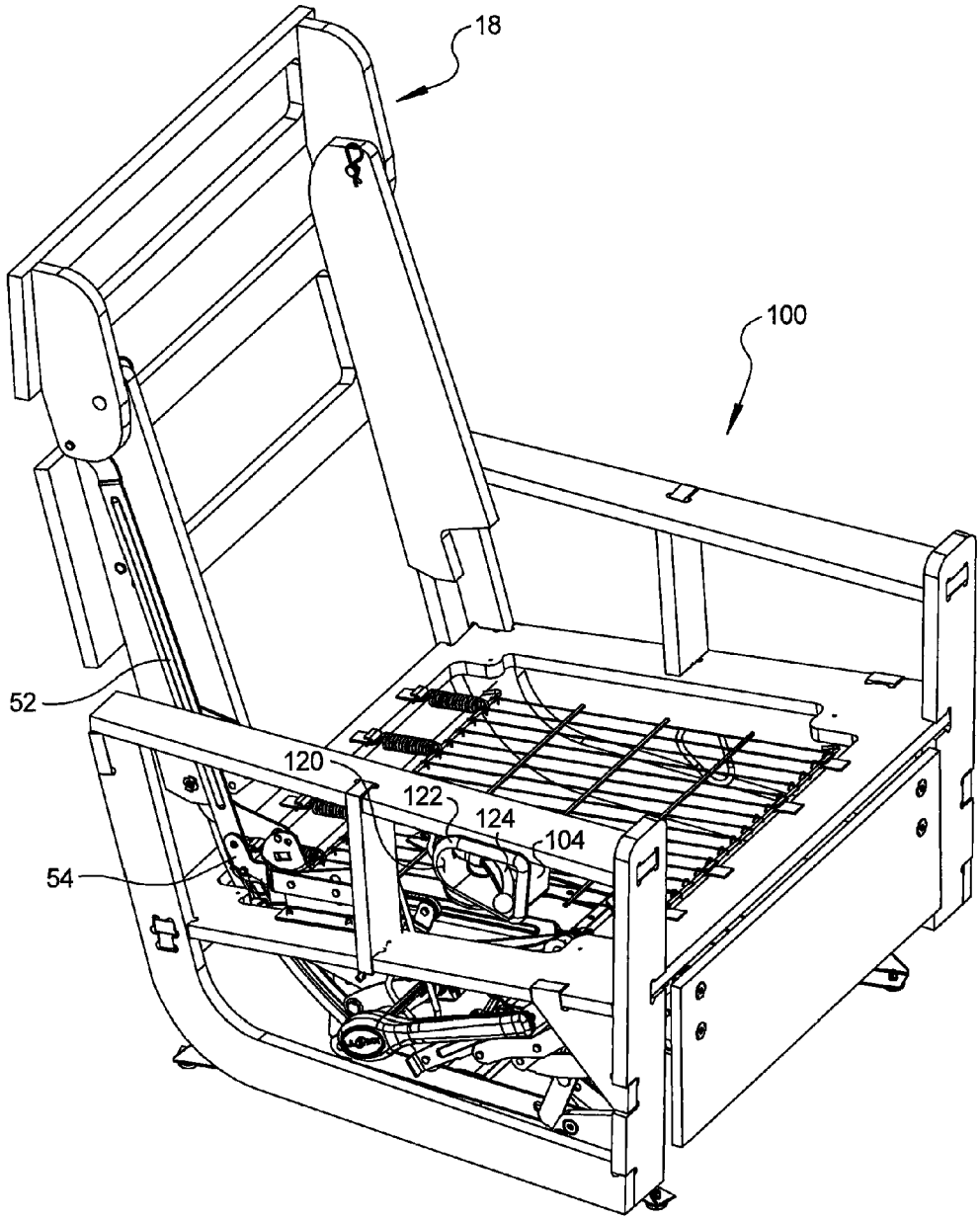
FIG. 13 is a right front perspective view of the furniture member of FIG. 12.
Figure 14:
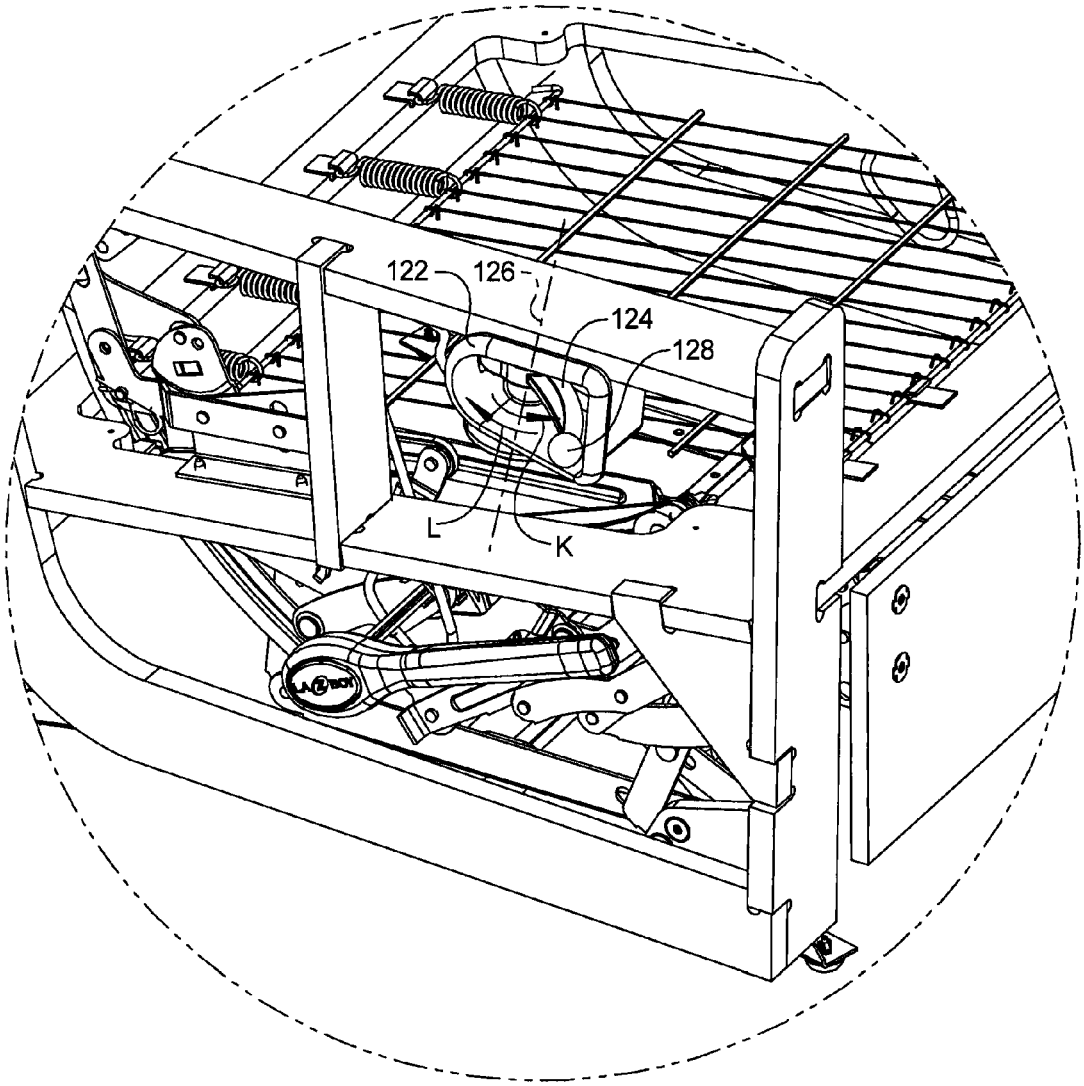
FIG. 14 is a right front perspective view similar to FIG. 13, showing further details of the drive mechanism.

Referring to FIGS. 13 and 14, drive mechanism 102 is coupled to housing 106 within a cavity 120 of housing 106. Housing 106 can be a molded polymeric member having an escutcheon or face plate 122 either homogenously or mechanically connected to housing 106 forming a rounded surface adapted to overlap an upholstery covering of furniture member 100 (not shown). Drive mechanism 102 includes a handle 124 which is manually rotatable about an axis of rotation 126. Handle 124 can include a hand grip feature 128, for example a rounded knob, to assist in manually rotating handle 124 in either of a first direction "K" or an opposed second direction "L". Full displacement of handle 124 within cavity 120 defines only a portion of displacement travel for wire member 110 (shown in reference to FIG. 12), therefore rotation of handle 124 is aided by a force multiplying capability of drive mechanism 102. Rotation of handle 124 concomitantly rotates modified adjustment lever 56' which displaces link connecting end 54 and therefore translates actuation link 52 to adjust the position of head rest assembly 18 as previously described herein.

Head rest assembly adjustment devices of the present disclosure offer several advantages. By providing a rotatable handle which is adjustable by an operator of the furniture member and connecting the rotatable handle using an actuation link to a rotatable head rest assembly, the head rest assembly can be rotated to provide more or less head support to an occupant of the furniture member. By locating the adjustment device handle between the operator or occupant of the furniture member and an arm rest support member of the furniture member the occupant can reach the adjustment device handle without reaching outside of the arm rest support member in any of the rotated positions of the back support member between a fully upright and a fully reclined position. Also, the head rest assembly adjustment devices of the present disclosure are not effect by the position of an associated leg rest assembly of the furniture member anywhere between a stowed and fully extended position of the leg rest assembly.

By providing detent positions for the adjustment device lever or handle, predetermined positions of the head rest assembly can be achieved which also provide the capability of maintaining the head rest assembly in one of the predetermined positions until it is desired by the occupant to change the head rest position. A force multiplying drive mechanism can also be used to change the rotated position of the head rest assembly. Because the force multiplying drive mechanism incrementally rotates the head rest assembly, a greater degree of rotational positions is available using this mechanism than the adjustment device handle.

What is claimed is:

1. A furniture member head rest adjustment system, comprising:

an occupant support base having an arm rest support member;

a back support member rotatable with respect to the occupant support base;

a head rest assembly rotatably connected to the back support member; and an adjustment lever movable by rotation to rotate the head rest assembly, the adjustment lever positioned between an occupant of the furniture member positioned on the base member and the arm rest support member so that the occupant can adjust the position of the head rest assembly without reaching outside of the arm rest support member.

2. The furniture member head rest adjustment system of claim 1, further including an actuation link rotatably connected at a first end to the head rest assembly and at an opposed second end to the adjustment lever, such that rotation of the adjustment lever operates to displace the actuation link to rotate the head rest assembly to a plurality of support positions.

3. The furniture member head rest adjustment system of claim 2, wherein the back support member includes first and second parallel opposed wings, with the actuation link positioned proximate the second wing.

4. The furniture member head rest adjustment system of claim 3, further comprising:

opposed first and second side support members of the head rest assembly rigidly connected by a brace member; and first and second fasteners, the first fastener disposed through both the first side support member and the first wing, and the second fastener disposed through both the second side support member and the second wing, the first and second fasteners defining an axis of rotation of the head rest assembly.

5. The furniture member head rest adjustment system of claim 4, further comprising a connecting fastener rotatably joining the first end of the actuation link to the second side support member, the connecting fastener being horizontally spaced from the second fastener such that displacement of the actuating link operates to induce rotation of the head rest assembly about the axis of rotation of the head rest assembly.

6. The furniture member head rest adjustment system of claim 2, further including an axis of rotation of the back support member with respect to the occupant support base being spatially separated from an axis of rotation of the adjustment lever such that rotation of the back support member with respect to the occupant support base independently operates to displace the actuation link to rotate the head rest assembly without rotation of the adjustment lever.

7. The furniture member head rest adjustment system of claim 1, further including:

a bracket fixedly connected to the occupant support base; and a pin rotatably connecting the adjustment lever to the bracket, a longitudinal axis of the pin defining the axis of rotation of the adjustment lever.

8. The furniture member head rest adjustment system of claim 1, wherein the adjustment lever includes a handle grip member adapted to permit the adjustment lever to be directly manually rotatable.

9. A head rest adjustment system for a furniture member, comprising:

a back support member rotatable with respect to an occupant support base member;

a head rest assembly rotatably connected to the back support member;

an adjustment lever manually rotatable from a neutral position in a first adjustment direction to rotate the head rest assembly from a neutral position in a head rest forward direction, and from the neutral position oppositely in a second adjustment direction to rotate the head rest assembly in a head rest reclining direction;

an actuation link rotatably connected at a first end to the head rest assembly and at an opposed second end to the adjustment lever, such that rotation of the adjustment lever operates to displace the actuation link to rotate the head rest assembly to a plurality of support positions; and an axis of rotation of the back support member with respect to the base member being spatially separated from an axis of rotation of the adjustment lever such that rotation of the back support member with respect to the base member independently operates to displace the actuation link to rotate the head rest assembly without rotation of the adjustment lever, a total angular displacement of the head rest assembly increasing in the head rest forward direction when the adjustment lever is fully extended in the first adjustment direction prior to the back support member being fully rotated in a reclining direction.

10. The head rest adjustment system of claim 9, further comprising a mechanism connected to the base member, the back support member connected to the mechanism to permit the back support member to rotate with respect to the base member within a range bounded by an upright position and a fully reclined position.

11. The head rest adjustment system of claim 10, wherein an angular orientation of the head rest assembly with respect to the back support member continually changes as the back support member rotates from the upright position to the fully reclined position.

12. The head rest adjustment system of claim 9, further comprising a flexible sheath;

a wire member slidably disposed within the flexible sheath;

a force multiplying drive mechanism including a handle rotatable to displace the wire member within the flexible sheath; and wherein the wire member is connected to the adjustment device handle wherein rotation of the handle of the force multiplying device operates to rotate the adjustment lever which displaces the actuation link to rotate the head rest assembly, a full displacement of the handle within a cavity of the drive mechanism defining only a portion of displacement travel for the wire member and therefore only a portion of displacement travel of the adjustment lever.

13. The head rest adjust system of claim 12, further comprising a rotatable connector fixedly receiving the wire member and rotatably connected to the adjustment device handle.

14. The head rest adjustment system of claim 9, wherein the adjustment lever includes a handle grip member adapted to permit the adjustment lever to be directly manually rotatable to selectively position the head rest assembly in the plurality of support positions including at least each of a neutral position, a maximum forward position, and a maximum rearward position.

15. The head rest adjustment system of claim 9, wherein the adjustment lever is positioned between an occupant of the furniture member positioned on the base member and an arm rest support member of the base member so that the occupant can adjust the position of the head rest assembly without reaching outside of the arm rest support member.

16. The head rest adjustment system of claim 9, further comprising a leg rest member connected to the mechanism and extendable within a range bounded by a fully retracted position and a fully extended position without altering any of the plurality of support positions of the head rest assembly.

17. The head rest adjustment system of claim 9, wherein the back support member includes first and second parallel opposed wings, with the actuation link positioned proximate the second wing.

18. The head rest adjustment system of claim 9, further including a bracket fixed to the occupant support base member, wherein the adjustment lever is rotatably connected to the bracket by a pin defining the axis of rotation of the adjustment lever.

19. A furniture member head rest adjustment system, comprising:

an occupant support base;

a back support member rotatable with respect to the occupant support base;

a head rest assembly rotatably connected to the back support member;

an adjustment lever operable to rotate the head rest assembly;

a force multiplying drive mechanism connected to the adjustment lever operating to incrementally rotate the adjustment lever using a handle manually rotatable about an axis of rotation;

a wire member slidably displaced within a flexible sheath by actuation of the drive mechanism such that the wire member extends or retracts to displace the adjustment lever; and a full displacement of the handle within a cavity of the drive mechanism defining only a portion of displacement travel for the wire member and thereby the adjustment lever.

20. The furniture member head rest adjustment system of claim 19, further including an arm rest support member of the occupant support base, wherein the adjustment lever is positioned between an occupant of the furniture member positioned on the base and the arm rest support member so that the occupant can adjust the position of the head rest assembly without reaching outside of the arm rest support member.

21. The furniture member head rest adjustment system of claim 19, further including an actuation link rotatably connected at a first end to the head rest assembly and at an opposed second end to the adjustment lever, such that rotation of the adjustment lever operates to displace the actuation link to rotate the head rest assembly to a plurality of support positions.

22. A furniture member head rest adjustment system, comprising:

an occupant support base having an arm rest support member;

a back support member rotatable with respect to the occupant support base;

a head rest assembly rotatably connected to the back support member;

an adjustment lever manually operated from a neutral position to either of opposite first and second head rest adjustment directions to rotate the head rest assembly, the adjustment lever positioned between an occupant of the furniture member positioned on the base member and the arm rest support member; and an actuation link rotatably connected at a first end to the head rest assembly and at an opposed second end to the adjustment lever, such that rotation of the adjustment lever operates to displace the actuation link to synchronously rotate the head rest assembly to a plurality of support positions without motion of the adjustment lever;

wherein the plurality of support positions includes at least a neutral position having the head rest assembly substantially parallel with the back support member, a rearward position rotated in a direction away from the occupant, and a forward position rotated in a direction toward the occupant, a maximum forward position reached by rotating the adjustment lever from the neutral position in the first head rest adjustment direction after the head rest reaches the forward position by synchronous rotation.

23. The furniture member head rest adjustment system of claim 22, wherein an axis of rotation of the back support member with respect to the occupant support base is spatially separated from an axis of rotation of the adjustment lever such that rotation of the back support member with respect to the base member independently operates to displace the actuation link to rotate the head rest assembly without rotation of the adjustment lever.

24. The furniture member head rest adjustment system of claim 23, wherein an angle between the rearward and forward positions is approximately 18 degrees when the head rest assembly is rotated by displacement of the actuation link without rotation of the adjustment lever by rotation of the back support member from an upright to a fully reclined position.

25. The furniture member head rest adjustment system of claim 22, wherein an angle between the rearward and forward positions is approximately 22 degrees when the head rest assembly is rotated using the adjustment lever.

26. A method for controlling adjustment of a furniture member head rest assembly, the furniture member having an occupant support base having an arm rest support member, a back support member, an occupant support base, an adjustment lever, and an actuation link, the method comprising:

rotatably joining the back support member to the occupant support base;

rotatably connecting the head rest assembly to the back support member;

positioning the adjustment lever between an occupant of the furniture member positioned on the base member and the arm rest support member, the adjustment lever operable to rotate the head rest assembly;

rotatably coupling the actuation link to both the head rest assembly and to the adjustment lever; and rotating the adjustment lever to simultaneously displace the actuation link and rotate the head rest assembly, without the occupant reaching outside of the arm rest support member.

27. The method of claim 26, further comprising rotating the adjustment lever to adjust the head rest assembly from a neutral position having the head rest assembly substantially parallel with the back support member to a rearward position rotated in a direction away from the occupant.

28. The method of claim 26, further comprising rotating the adjustment lever to adjust the head rest assembly from a neutral position having the head rest assembly substantially parallel with the back support member to a forward position rotated in a direction toward the occupant.

* * * * *